United States Patent [19]

Clarke

[11] 4,266,415

[45] May 12, 1981

[54] PNEUMATIC DOOR LOCKS

[76] Inventor: Walter W. H. Clarke, Brooklands, Marsh La., Eversley, Hampshire, England

[21] Appl. No.: 63,908

[22] Filed: Aug. 6, 1979

[30] Foreign Application Priority Data

Aug. 8, 1978 [GB] United Kingdom ..... 32587/78

[51] Int. Cl.[3] ..... E05B 19/06; E05B 35/08; E05B 37/16; E05B 51/02

[52] U.S. Cl. ..... 70/264; 70/275; 70/316; 70/352; 70/385; 70/405; 70/DIG. 48

[58] Field of Search ..... 70/DIG. 48, 275, 352, 70/350, 405, 286, 263, 339, 385, 316, 264

[56] References Cited

U.S. PATENT DOCUMENTS

| | | | |
|---|---|---|---|
| 299,066 | 5/1884 | Fuller | 70/DIG. 48 |
| 1,406,813 | 2/1922 | Bailly | 70/275 X |
| 1,797,384 | 3/1931 | Ward et al. | 70/DIG. 48 |
| 1,986,125 | 1/1935 | Teichmann | 70/299 |
| 2,298,776 | 10/1942 | Rhein | 70/275 X |
| 2,692,495 | 10/1954 | Verdan | 70/405 X |
| 3,505,841 | 4/1970 | Sinclair | 70/350 |
| 3,524,334 | 8/1970 | Salvesen | 70/275 |
| 3,680,336 | 8/1972 | Schendel | 70/352 X |
| 3,780,548 | 12/1973 | Anastasov | 70/352 |
| 3,893,314 | 7/1975 | Raymond | 70/339 |
| 4,114,410 | 9/1978 | Astier | 70/385 X |

FOREIGN PATENT DOCUMENTS

| | | | |
|---|---|---|---|
| 651377 | 2/1929 | France | 70/352 |
| 676929 | 11/1964 | Italy | 70/DIG. 48 |
| 1419375 | 12/1975 | United Kingdom | 70/264 |

*Primary Examiner*—Roy D. Frazier
*Assistant Examiner*—Carl F. Pietruszka
*Attorney, Agent, or Firm*—Anthony J. Casella

[57] ABSTRACT

A door lock, in particular a lock for hotel room doors. Actuation of the exterior door handle creates a supply of compressed air which is directed through a coding assembly to actuate a lock release member. The operation of the coding assembly is controlled by a pair of matching punched cards. One of the cards is normally positioned within the lock and the other card is retained by an authorized user for insertion into the lock to operate the coding assembly. Two separate coding assemblies are provided with a hotel door lock, one being for use by a guest and the other under the control of the hotel management.

5 Claims, 7 Drawing Figures

PNEUMATIC DOOR LOCKS

The present invention concerns door locks. In particular, the invention seeks to provide a lock for an hotel bedroom door and which can overcome the security problem of a guest leaving the hotel without returning the room key. The lock as now proposed does not rely on conventional keys and thereby avoids the security problem associated with lost or missing keys.

According to the invention there is provided a lock comprising means for pressurising a fluid and means for directing the pressurised fluid to actuate a lock release, said directing means comprising a coding system operable only in the event of the introduction of correct information into the lock.

The coding system can comprise a valve assembly operable to selectively open and close a flow passage for the pressurised fluid, the operation of the valve assembly being controlled by a pair of matching punched cards. One of the cards is normally positioned within the lock while the other card is retained by an authorised user for insertion into the lock to operate the valve assembly.

Two separate coding systems can be provided with an hotel door lock, one system being for use by a guest and the other system being under the control of the hotel. Conveniently, a warning system can be associated with the lock such that an alarm is actuated in the event of unauthorised use or interference with the lock.

The invention will be described further, by way of example, with reference to the accompanying drawings; in which:

FIG. 1 is a functional diagram of a lock;

FIGS. 2*a* and 2*b* are front and end elevational views respectively of the lock;

Figure 2B:
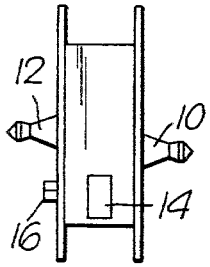
Figure 2A:
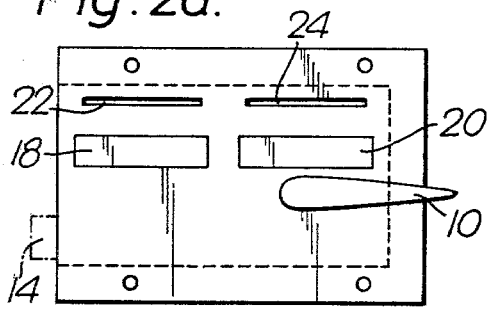

With reference to the drawings, FIGS. 2*a* and 2*b* show one example of a lock according to the invention for use in hotel bedroom doors. The lock can be dimensioned to fit into a rectangular cut-out in an hotel bedroom door and can be fitted with lever door handles 10 and 12 on the outside and inside door faces respectively. The handle 12 on the room side of the door is mechanically coupled direct to lock bolt 14 whereby the door can be opened from the inside on turning the handle 12. A locking catch 16 on the inside of the lock is coupled directly to the lock bolt and is provided with an overriding linkage as will be mentioned hereinafter.

The outside face of the lock, that is the face on the outside of the bedroom door, is formed with two rectangular doors 18 and 20 which, when open, enable the insertion and withdrawal of so-called control cards. Two slots 22 and 24 located above the doors 18 and 20 receive so-called insert cards.

The lock incorporates a guest card section and a master card section, each section comprising a valve assembly. The guest card section can have eighteen coding valves arranged in three staggered rows of six and the master card section can be divided into three staggered rows of seven, six and seven valves. The above arrangements are examples only of many possible alternatives. The valves can be at different spacings in the sections.

Figure 3:
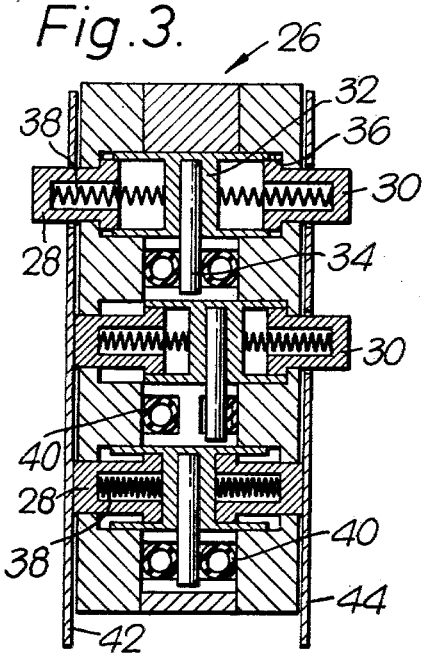
FIG. 3 illustrates an embodiment of a valve assembly.

FIG. 3 is a section through a valve assembly 26. The assembly 26 comprises a housing for the three rows of coding valves, each coding valve comprising a pair of spaced apart spring-loaded plungers 28 and 30. Each pair of plungers is associated with a corresponding slide 32 which is movable within a bore 36 in the housing and carries a peg 34. Normally, the ends of the plungers project through openings in the side walls of the housing under the action of springs 38 and each slide 32 with its peg 34 is central within the housing. A continuous length of a small diameter resiliently flexible tube 40 passes through the valve assembly at the guest card section. The tube is arranged to pass first along one side of each peg in a row, then along the opposite side of each peg in the same row, and to continue similarly for the remaining two rows of pegs. When a peg is displaced to either the left or the right as viewed in FIG. 3 the tube is compressed and clamped closed at that position. The displacement of a slide or slides is achieved by the control and insert cards. In FIG. 3, a control card is denoted by reference numeral 42 and an insert card by reference numeral 44. In FIG. 3 the control and insert cards have matching apertures at the position of the uppermost pair of plungers whereby three plungers project through the cards. The associated slide 32 and peg 34 remain in the central position and the tube 40 remains open at each side of this peg.

Likewise, the portion of the tube 40 at each side of the peg associated with the lowermost pair of plungers remains open. In this position the plungers are held within the housing as the two cards have no matching apertures. However, in the middle row in FIG, 3 only the card 44 has an aperture for the corresponding plunger 30. In this case plunger 30 extends through the card 44 but the plunger 28 is held within the housing by the card 42. As a result, the peg is displaced to the right to compress and clamp the tube 40 as shown in FIG. 3.

Figure 5:
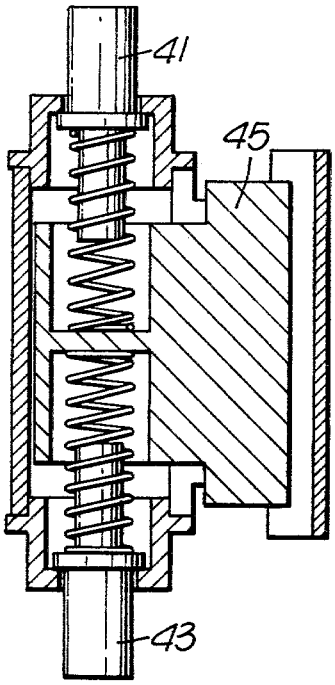
FIG. 5 illustrates an alternative form of valve.

FIG. 5 is a section through another embodiment of a valve assembly. As before, each valve of the assembly comprises a pair of spring-loaded plungers 41 and 43 with an associated valve member 45 which is normally biassed to its neutral central position. The valve assembly functions in the same manner as that of FIG. 3 to squeeze closed the flexible tube 40.

Figure 4:
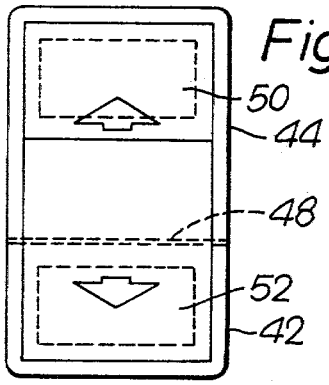
FIG. 4 shows a code card with control and insert portions.

FIG. 4 is an example of a card for insertion in the guest card section of the lock. The card is formed from a stiff material, conveniently a plastics/paper laminate although it can be metal. The card is divided into the guest insert card 44 and the guest control card 42 along a line of weakness 48, such as a row of perforations. The guest insert card 44 and the guest control card 42 are punched or otherwise provided wth identical matching codes within the respective coding areas 50 and 52. The insert card can carry advertising and both cards are marked to show the correct direction of insertion during use. The insert card 44 is for use by the guest and the guest control card 42 is located in the lock by the hotel management.

The cards for use in the master card section of the lock are similar. However, the master section of the lock is preferably provided with three levels of mastering and it may be convenient to provide the guest and master cards with different colours or designs for rapid and easy identification. The guest and master insert cards do not have interchangeable codings.

Figure 1:
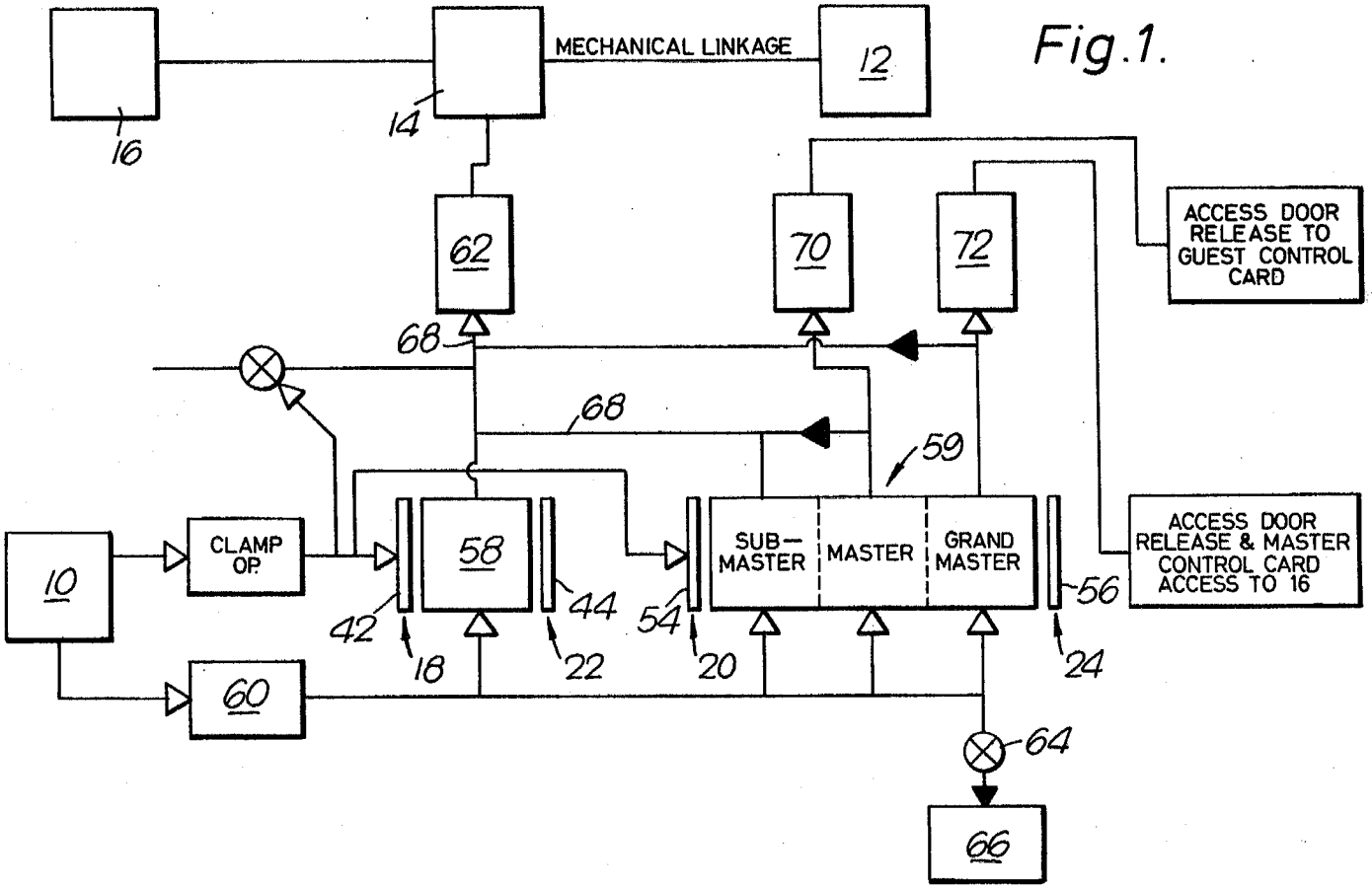

With reference to the functional lock diagram of FIG. 1, the external handle 10 is denoted by the correspondingly numbered block and likewise the internal handle 12. In this diagram, the plain arrow heads denote positions for card entry into the lock, that is the slots 22 and 24 and the access doors 18 and 20. The open triangular arrow heads represent fluid flow directions and the blanked arrow heads represent non-return valves.

Initially, the guest control card 42 and a master control card 54 are introduced into the lock through the respective access doors 18 and 20 by the hotel management. The doors are closed and cannot thereafter be opened until an appropriate guest card is introduced through slot 22 or an appropriate master insert card 56 is introduced into the lock through slot 24.

To gain access to the room a guest introduces his or her insert card 44 into the lock through the slot 22. Initial turning of the handle 10 causes the cards to be clamped and sensed in a platen comprising the valve assemblies. The action is such as to clamp the guest control card 42 against the adjacent face of valve asembly 58 and to urge the valve assembly 58 against the guest insert card 44, the latter abutting against a permanent stop. A similar action takes place at the master section of the lock.

If the guest insert card 44 matches the guest control card 42 previously deposited in the lock then the coding valves in the assembly 58 remain central to the two cards. Further continued movement of the door handle 10 compresses fluid, conveniently air, in pump cylinder 60 and air passes through the resiliently flexible tube 40 in the assembly 58 to actuate a piston assembly 62. The latter is mechanically coupled to the lock bolt 14 to withdraw the bolt and allow the door to open.

If an incorrect guest insert card is introduced into the lock and the handle 10 is turned then the resiliently flexible tube 40 will be clamped closed at the or each position where the coding on the insert card 44 differs from that on the control card 42. Movement of the handle 10 will still compress the air but the compressed air will vent through an excess pressure valve 64. The lock will remain secure. Conveniently, the venting through the excess pressure valve 64 can actuate an alarm 66. Such an alarm can be a sonic or ultra-sonic device which can be used in a number of different ways. The sonic note can be loud enough to alert hotel staff. Alternatively, the sonic or ultra-sonic note may be tuned precisely and detected by an acoustic receiver tuned to that note. Such a receiver can be used to alert a master closed circuit television or video tape apparatus to view the person attempting to open the door. Again, the sonic or ultra-sonic note may be detected and used to actuate an alarm on a master control panel in a security room.

Figure 6:
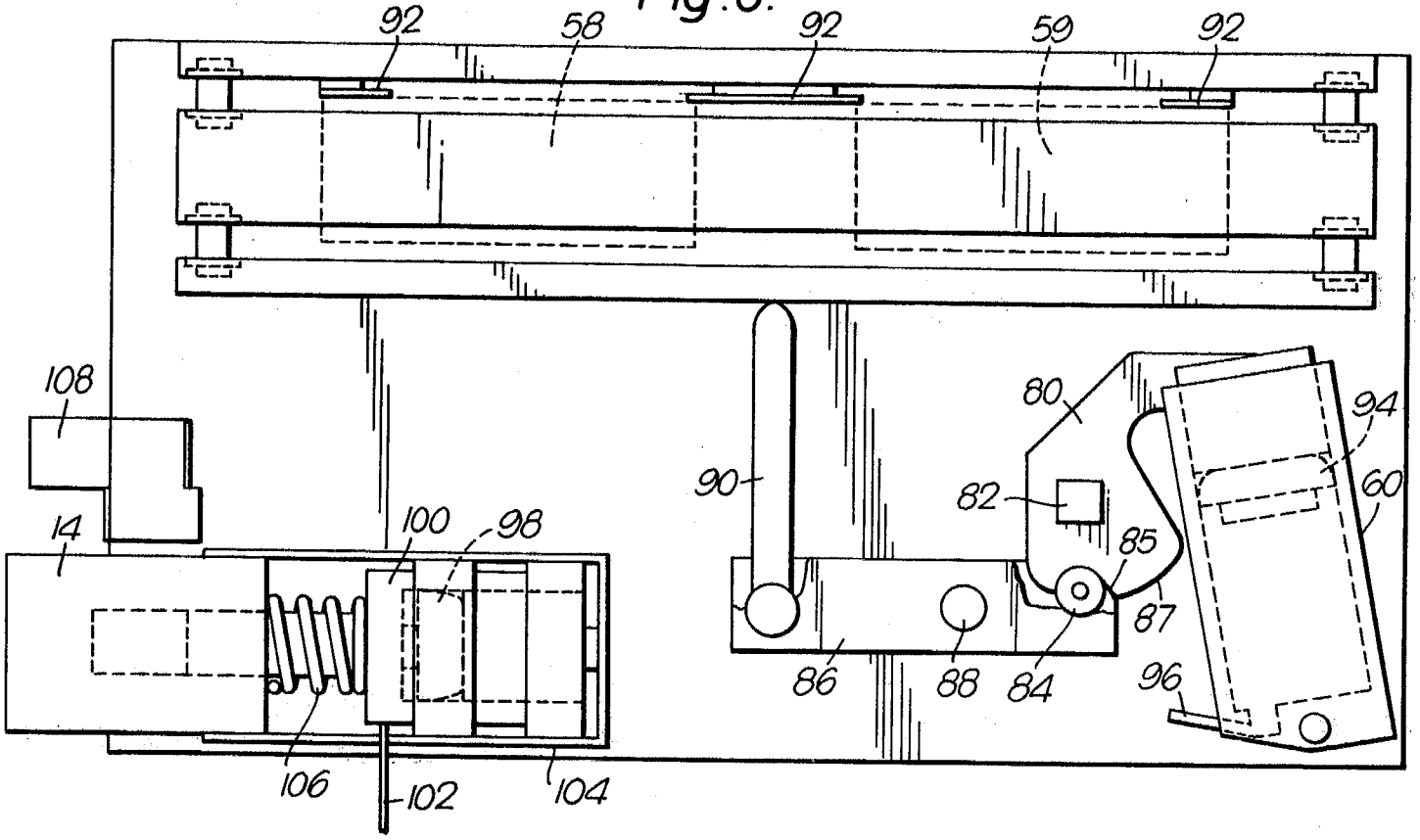
FIG. 6 is a schematic diagram of the lock.

FIG. 6 is a schematic diagram of a part of the lock and omitting the compressed air flow lines. A cam 80 is keyed on the spindle 82 of the handle 10. The cam 80 bears against a roller 84 mounted at one end of a rocker arm 86, the arm 86 being pivotable about axis 88. A push rod 90 is pivotally attached at one end to the opposite end of the rocker arm 86. The opposite end of the rod 90 engages sensing platen comprising the guest valve assembly 58 and the master valve assembly 59. The valve assemblies are denoted by the dotted outlines. Guides 92 are provided for receiving and supporting the insert and control cards.

The cam 80 is coupled to a piston 94 in the pump cylinder 60. A spigot connection 96 is provided for receiving an end of the resiliently flexible tube 40. The piston assembly 62 of well known form (see FIG. 6) comprises a piston 98 slidable in cylinder 100 and having a spigot connection 102 for the tube 40. The piston 98 is moved against the action of a spring (not shown) to displace a saddle 104 which is connected to the bolt 14. On the interior side of the door, the handle 12 can be a slide knob which is coupled to the saddle 104 whereby the bolt 14 can be withdrawn against the action of a return spring 106. The lock can also incorporate a sub-bolt 108 which allows the bolt 14 to spring back into its locking position when the door is closed but prevents the bolt 14 from being pushed back by standard lock picking techniques, when the door is closed.

The operation is such that during initial turning of the handle 10 the roller 84 rides over the ramp 85 to cause the rocker arm 86 to pivot and thereby move the push rod 90 to actuate the sensing platen and clamp the cards in position in the respective valve assemblies. Continued movement of the handle 10 causes the roller 84 to ride along the plateau 87 to displace the piston 94 and pressurise the air.

The master section 59 of the lock functions in a manner similar to the guest section but the master section incorporates three levels of mastering, namely, sub-master, master and grand master. The coding valves are arranged in three rows and each row provides one level of mastering. As seen from FIG. 1, a fluid path is associated with each level.

When a correct sub-master insert card is introduced through the slot 24 in the door and the handle 10 is turned, air can flow along the first path into line 68 (FIG. 1) to the piston assembly 62 to release the bolt 14. Such a sub-master insert card could be used by a chamber maid.

A master insert card also allows air to pass along the first path into line 68 to actuate the piston assembly 62 to release the bolt 14. In addition, air can pass along the second path to a second piston assembly 70 which functions to release the access door 18 to the guest control card. The master card therefore enables the room door to be opened and the guest control card to be removed and changed. Thus when a guest vacates the room at the end of a stay at the hotel the control card is removed and replaced with a new guest control card which latter will correspond to a new guest insert card supplied to the next guest or visitor.

A grand master insert card allows air to pass to both the piston assemblies 62 and 70 and along the third path to a third piston assembly 72. The assembly 72 functions to release the access doors 18 and 20 to both the guest and master control cards. In addition, it actuates an override control for the guest's locking catch 16 thereby enabling the room door to be opened even when locked on the inside.

A master insert card inserted in the guest section of the lock or a guest insert card inserted in the master section of the lock will not operate the lock as the codings in the two are different.

It maybe possible to operate the lock in the absence of cards therein or when totally blank cards are placed in the insert and control sections. In each case the valves of the assemblies can occupy their neutral, central positions so permitting the flow of compressed air to release the bolt on turning the handle. To avoid this possibility and as an additional security feature one plunger of a valve can be arranged to be permanently pushed in and a plunger of another valve can be shortened so that it cannot protrude to be contacted by a card. In order to actuate the lock initially if these features are included it is therefore necessary to insert a card having a single hole therein at a position associated with that of the shortened plunger.

The lock as described herein provides a versatile lock for an hotel room having a function which can be changed each time a guest vacates the room and which has three levels of mastering. It will be appreciated that a simplified version of the lock can be used for domestic door locks and the like. In such applications it is only required to provide the so-called guest insert and control assemblies and the control card can be inserted through an access located on the inside of the door.

I claim:

1. A door lock comprising an operating handle for mounting on an external face of the door and a locking bolt for securing the door in a closed position, the lock comprising a coding valve assembly comprising a plurality of pairs of spring-loaded plungers each pair biassing a valve member to a central, neutral position, a continuous length of a resiliently flexible tube disposed at opposite sides of each of said valve members, a fluid pressurising member operable in response to operation of the handle being connected to one end of the tube, a complementary fluid pressurized member operable to release the bolt being connected to the other end of the tube, a first code card insertable in the lock and cooperable with the ends of the plungers at one side of the valve assembly, a second code card and access means in the lock for introducing the second code card into the lock to cooperate with the ends of the plungers at the opposite side of the valve assembly whereby, in the event that the coding on the second code card matches the coding on the first card the pairs of valve plungers are subjected to the same constraints and the valve members remain in their central, neutral positions to permit communication between the fluid pressurising member and the complementary release member to release the lock bolt and in the event of a mismatching of the coding on said cards at least one of the plungers is displaced to move the associated valve member, to squeeze closed the tube thereby blocking communication between the pressurising member and the complementary member to prevent release of the lock bolt.

2. A door lock according to claim 1 in which the valve assembly comprises first and second separate sections, the first section being operable in response to said first and second code cards and the second section being divided into at least two independently operable stages.

3. A door lock according to claim 2 in which the second section is divided into three stages.

4. A door lock according to claim 3 in which a first of said stages operates to release the bolt, a second stage operates to release the bolt and to gain access to the code card, and the third stage operates to gain access to said card, a master control card and to release a locking catch on the inside of the door.

5. A door lock according to claim 4 in which an alarm is operable upon actuation of the handle after the insertion of an incorrect code.

* * * * *